United States Patent [19]

Mahoney

[11] Patent Number: 4,790,340

[45] Date of Patent: Dec. 13, 1988

[54] CANOPY FOR A CHILD'S PLAYPEN

[76] Inventor: Diane P. Mahoney, 28 Lowell St., Pepperell, Mass. 01463

[21] Appl. No.: 152,986

[22] Filed: Feb. 8, 1988

[51] Int. Cl.[4] ..... E04H 15/04

[52] U.S. Cl. ..... 135/90; 135/104; 135/96

[58] Field of Search ..... 135/104, 102, 96, 90

[56] References Cited

U.S. PATENT DOCUMENTS

| | | | |
|---|---|---|---|
| 165,665 | 7/1875 | Fairbanks | 135/96 |
| 1,264,078 | 4/1918 | Jaureguy | 135/96 |
| 2,820,468 | 1/1958 | Park | 135/96 |
| 2,953,145 | 9/1960 | Moss | 135/104 |
| 2,964,759 | 12/1960 | Riggs | 135/96 |
| 3,307,565 | 3/1967 | Laccarelli | 135/102 |
| 3,423,767 | 1/1969 | Crook | 135/96 |
| 3,766,573 | 10/1973 | Burkholz | 135/102 |
| 4,092,809 | 6/1978 | Bellas | 135/102 |

*Primary Examiner*—Henry E. Raduazo

*Attorney, Agent, or Firm*—Irwin P. Garfinkle

[57] ABSTRACT

This patent discloses a playpen canopy comprising 4 universal mounting connectors which are readily removably attached to each of the corners of a conventional collapsible playpen of the type popularly in use. The depicted canopy is a dome shaped cloth fabric supported by two flexible poles which pass through elongated crossed pockets in the fabric. The poles are fixed to one another in the elongated pockets by means of a pivot extending through their centers. The ends of each pole are supported at diagonally opposite corners of the play pen by the 4 universal mounting connectors which are provided with latching means for securing the corners of the canopy thereto.

3 Claims, 2 Drawing Sheets

CANOPY FOR A CHILD'S PLAYPEN

BACKGROUND OF THE INVENTION

This invention relates to canopies for playpens for young children, and more particularly to a collapsible canopy that may be mounted on a wide variety of styles and sizes of playpens. The canopy is comprised of a bottomless, tent type structure made of a cloth fabric and erected into a dome by a pair of crossed, flexible poles which are supported in universal connectors removably mounted on the corners of a conventional, unmodified playpen.

A search of the prior art reveals that there have been many attempts to provide canopies for children's cribs, playpens, and even for a swimming pool playpen. For example U.S. Pat. No. 4,008,497 issued to Badon shows an umbrella on a play pen supported in a swimming pool. U.S. Pat. No. 4,073,017 issued to Stevens shows a playpen enclosed with netting, and provided with a removable net top. Spencer, U.S. Pat. No. 3,351,323, shows a canopy pivoted on upright shafts which in turn are supported in connectors on the playpen. Heffernan et al, U.S. Pat. No. Re. 24,845, shows a simple canopy strapped to the top of a crib. U.S. Pat. No. 2,958,084 issued to Kenney shows a collapsible playpen of unique construction provided with a sun shade 46. Griesenbeck, U.S. Pat. No. 4,590,956, shows a tent similar in construction to my canopy, but used in combination with a mattress and requires a bottom. None of the foregoing patents shows a universal collapsible canopy which is easily mounted on the wide variety of conventional playpens that are currently used in the United States in great numbers.

BRIEF SUMMARY OF THE INVENTION

Briefly described, this invention is for a playpen canopy comprising 4 universal mounting connectors which are readily removably attached to each of the corners of a conventional collapsible playpen of the type currently in popular use, and as generally depicted in the drawings. The canopy top is a dome shaped cloth fabric supported by two flexible poles which pass through elongated, crossed pockets in the fabric. Preferably the poles are fixed to one another by means of a pivot extending through their centers, and the ends of each pole are supported at diagonally opposite corners of the play pen by the 4 universal mounting connectors. The 4 mounting connectors are provided with latching means for securing the corners of the canopy thereto.

DESCRIPTION OF THE FIRST EMBODIMENT OF THE INVENTION

Figure 1:
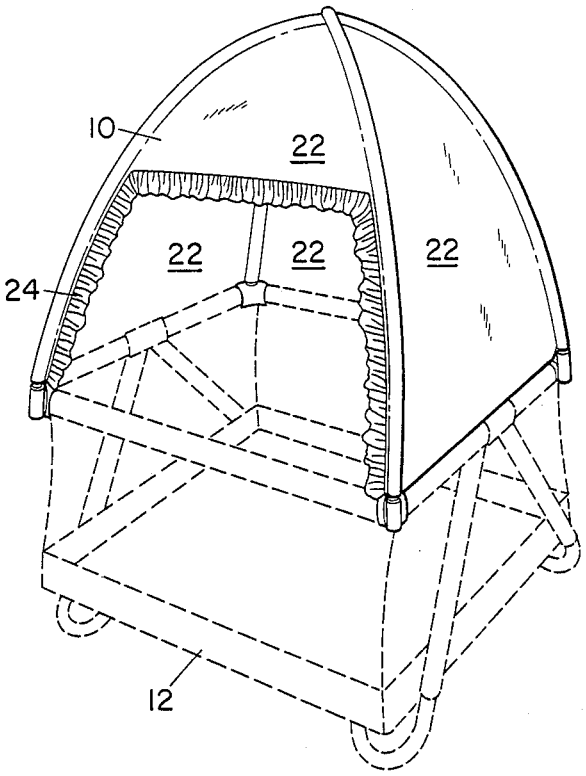
FIG. 1 is a perspective view of a canopy erected in accordance with my invention on a conventional playpen.
Figure 2:
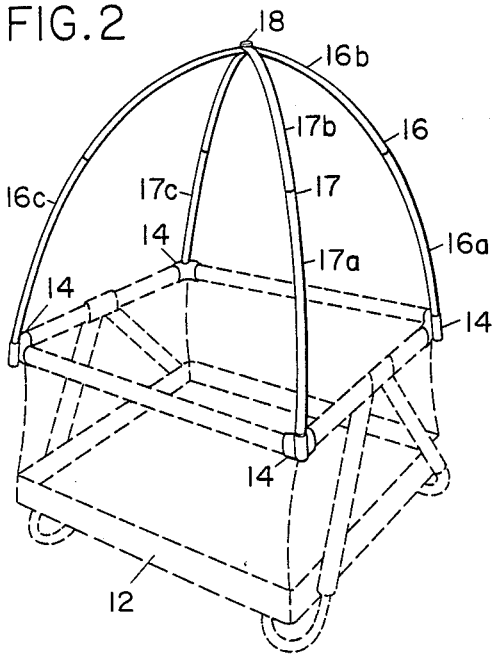
FIG. 2 is a view similar to FIG. 1 showing the structure of the erected canopy without the canopy fabric.

Referring first to FIGS. 1 and 2, the canopy, generally designated by the numeral 10 is shown erected on a conventional collapsible playpen 12. While the playpen forms no part of this invention, my invention does require a playpen having 4 corners, or the equivalent thereof, at which 4 universal mounting connectors 14 can be mounted. For example, a circular or oval playpen can utilize my canopy by mounting the connectors at intervals of approximately 90 degrees around the periphery of the playpen. My canopy is also useful without modification as a canopy for cribs and carriages provided only that such items have the spaced mounting positions that are required.

Figure 3:
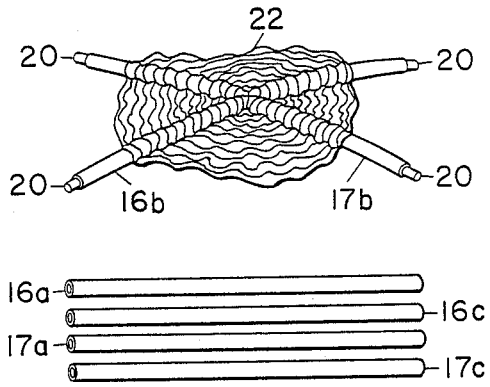
FIG. 3 shows an intermediate stage of erection of the canopy, with the center portions of the crossed poles in place within the pockets of the canopy fabric.

Referring to FIG. 2, where the canopy is shown erected without the canopy fabric, the canopy structure is comprised of two flexible telescoping poles 16 and 17, pivoted at their centers by means of a pin 18. The end of each of the flexible poles 16 and 17 are inserted into the connectors 14, and are flexed into an arch as shown. As seen in FIGS. 2 and 3, each of the poles 16 and 17 is made up in 3 telescoping sections, 16*a, b* and *c*, and 17*a, b* and *c*, the ends of the center sections 16*b* and 17*b* having dowels 20 therein for supporting the remaining 2 sections. The dowels 20 may be glued into the center sections to eliminate the possibility of loss when the canopy is disassembled.

Figure 6:
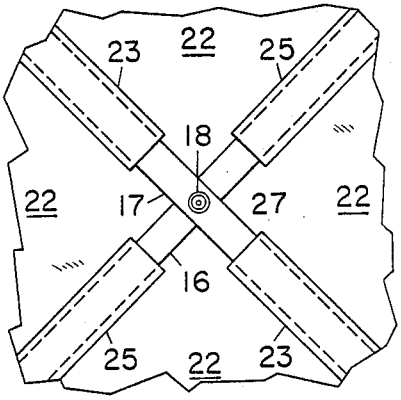
FIG. 6 is a view of the center portion of the dome as seen from the playpen.

The canopy cover is made up of 4 triangular cloth panels 22, which are sewn together at their edges to form two transverse pockets 23 and 25 which contain the poles 16 and 17, when erected at approximately right angles to one another. To facilitate assembly of the poles in the pockets, an interior opening 27 is provided at the junction of the pockets at the top of the dome on the inside. This enables the insertion of the pivot pin 18 through the two center sections after the pole sections are inserted in the pockets, as shown in FIG. 6.

One of the panels is formed with an opening and trimmed with a decorative ruffle 24. Depending only on style, one or more of the other panels can also be provided with one or more openings to permit the child to better view its surrounding environment. The canopy can be made from any material such as cotton, nylon, plastic or even canvas depending on the intended use. Since the canopy is mostly useful outdoors on only warm sunny days, the most likely use would be as a sun shield, and for that reason cotton sheeting normally would be satisfactory. If desired, a more water proof or sun resistant material may be selected. An of course, care should be exercised in using fabrics which are fire resistant.

The bottom of the canopy fabric is provided with 4 elastic loops 29, one at the bottom of each pocket. The elastic loop 29 in designed to engage and latch an adjacent connector 14 in a manner hereinafter to be described.

The canopy is assembled by inserting the two center sections 16*b* and 17*b* into their respective pockets, one sliding over the other at the mid points. The two sections are then pivoted together by means of the pin 18 inserted through the opening 27. Thus, the canopy fabric and the center sections of the poles are permanently assembled, even when the canopy structure is otherwise disassembled, and folded into a relatively small package.

Figure 4:
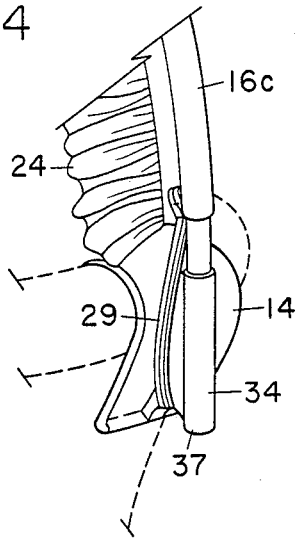
FIG. 4 is an enlargement of one of the four identical corners mounting connectors for supporting the canopy at the corners of the conventional playpen.
Figure 5:
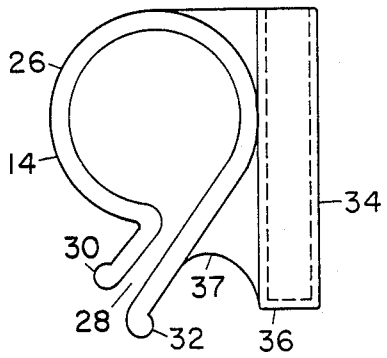
FIG. 5 is a vertical cross section of the connector.

As shown in FIGS. 4 and 5, the connectors 14, which are all identical comprise a generally c-shaped spring clip 26 having a downward facing opening 28 positioned at an angle of about 45 degrees from the vertical. The 45 degree angle provides a vector of resistance to removal of the clips in both the horizontal and vertical directions, thereby effectively resisting wind forces. The tips of the clip are provided with diverging or flared lips 30 and 32 to facilitate the spreading of the opening of the clip when it is forced on to a horizontal top rail of the play pen. Integral with the clip 26 is a cylindrical tube member 34 having an open top through which the end of the rods 16 and 17 are inserted. The end of each rod rests on a bottom wall 36.

It will be noted that the tube 34 projects downward below the clip 26 and provides a projection 37 over which the elastic loop 29 is hooked to provide a positive latch between the canopy and the connector.

DESCRIPTION OF THE SECOND EMBODIMENT

Figure 7:
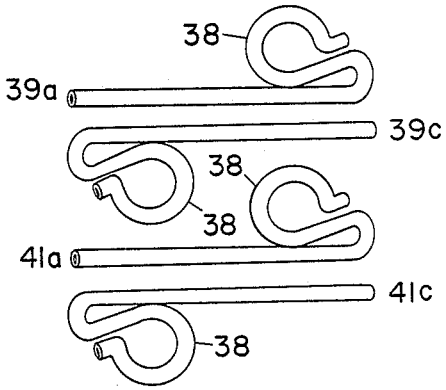
FIG. 7 illustrates a second embodiment of the invention, showing an alternate connector.
Figure 8:
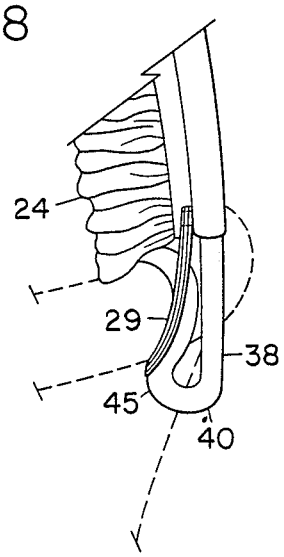
FIG. 8 is an enlargement of the connector in FIG. 7.
Figure 9:
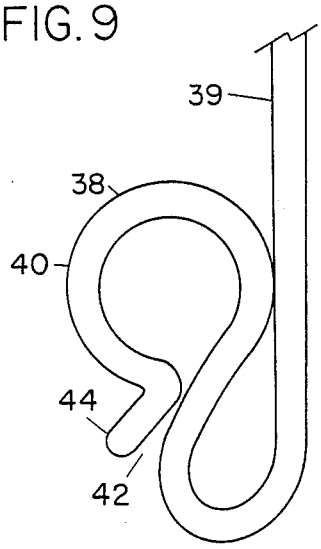
FIG. 9 is a plan view of all 4 connections of the embodiment.

The second embodiment of my invention is illustrated in FIGS. 7, 8 and 9, and it differs from the first embodiment only in the configuration of the connectors 38, as compared with the connectors 14.

The connectors 14 and 38 have the same characteristics in that both types clip onto the corners of a playpen, and the flexible poles are telescoped into the connector. Referring to FIGS. 7 and 8, each connector 38 is formed from a flexible hollow tube heat formed and bent into essentially the same cross section as the connector 14. Unlike connector 14, the connector 38 has an elongated portions 39, which can replace the end sections 16*a* and *b*, and 17*a* and *b*, so that the connector becomes integral with the flexible posts. In assembling the canopy, the dowels 20 are telescoped into the hollow tube portion 39 of the connector.

As best seen in FIG. 8, the connector 38 is formed with a spring clip 40 having a downward directed opening 42 at an angle of approximately 45 degrees, and it is also provided with a flared lip 44 to enable easier attachment of the connector to the playpen corner. The elastic latch 29 slip over the reverse loop 45 to latch the canopy to the connector.

It will be apparent to persons skilled in the art that this invention is subject to various modifications and adaptations without departing from the spirit thereof. For example, spring clips of various designs may be used so long it meets the following criteria: the clip should fit a wide variety of styles of playpens; it should be capable of supporting an end of a flexible rod; and it should have positive means for providing a latch between the canopy and the clip. Moreover, the canopy may be mounted on other furniture, as well as playpens, for example, cribs and carriages. It is also within the scope of this invention that the style of the canopy may be modified by adding windows or other similar features.

It is intended, therefore, that this invention be limited only by the appended claims as interpreted in the light of the prior art.

I claim:

1. A portable and collapsible canopy for use in combination with a conventional child's playpen, the combination comprising:

a pair of flexible rods;

a dome shaped canopy constructed of a fabric type material, said material having two integral elongated pockets intersecting at approximately 90 degrees at the midpoint of said canopy, one of said flexible rods being contained within one of said pockets, the other of said rods being contained in the other of said pockets, said rods being pivotally affixed to one another at said midpoint, whereby the canopy and rods are assembled as a collapsible unit;

four connectors configured for mounting on the rails of said playpen at the corners thereof, each of said connectors having means for vertically attaching an end of one said rods thereto, whereby said rods each flex into an arch and a dome shaped structure results, each of said connectors comprising a spring clip having a c-shaped cross section dimensioned for frictional engagement with a rail of a playpen when inserted thereon, said spring clip having a vertically oriented aperture on the top thereof for receiving the end of a rod, said spring clip having its opening oriented downward at an angle to provide a vector of resistance to removal in both the horizontal and vertical planes;

and locking means between said material and said connector for vertically locking said material to said connector, said locking means comprising a downward extending projection on each of said connectors, and an elastic loop secured to said material adjacent a respective connector, said loop being engagable with said projection to lock said canopy to said connector.

2. The invention as defined in claim 1 wherein said rods are constructed of a plurality of sections, and wherein each of said connectors is integral with an end section of said rods.

3. The invention as defined in claim 2 wherein each of said c-shaped spring clips is formed at the end of said end sections with its opening oriented downward at an angle of approximately 45 degrees, and having a flared lip to facilitate attachment to said rails.

* * * * *